US007811475B2

(12) United States Patent
Hayashi

(10) Patent No.: US 7,811,475 B2
(45) **Date of Patent: *Oct. 12, 2010**

(54) NEUTRON SHIELDING MATERIAL COMPOSITION, SHIELDING MATERIAL AND CONTAINER

(75) Inventor: Noriya Hayashi, Aichi-Ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 307 days.

This patent is subject to a terminal disclaimer.

(21) Appl. No.: 10/588,396

(22) PCT Filed: Feb. 4, 2004

(86) PCT No.: PCT/JP2004/001116

§ 371 (c)(1),
(2), (4) Date: Apr. 10, 2007

(87) PCT Pub. No.: WO2005/076287

PCT Pub. Date: Aug. 18, 2005

(65) Prior Publication Data

US 2008/0035891 A1 Feb. 14, 2008

(51) Int. Cl.

| | |
|---|---|
| ***G21F 1/00*** | (2006.01) |
| ***G21F 1/10*** | (2006.01) |
| ***G21F 1/12*** | (2006.01) |
| ***G21C 7/24*** | (2006.01) |

(52) U.S. Cl. ..... 252/478; 250/505.1; 250/515.1; 250/518.1; 264/239; 264/299; 523/445

(58) Field of Classification Search ..... 376/272; 250/518.1, 515.1, 505.1, 484.4; 252/478; 522/25–26, 28, 31, 71, 81, 83, 170; 324/754; 81/59.1; 523/445; 524/404; 264/239, 299
See application file for complete search history.

(56) References Cited

U.S. PATENT DOCUMENTS 3,982,134 A 9/1976 Housholder et al.
5,700,962 A * 12/1997 Carden ..... 75/236
7,327,821 B2 * 2/2008 Ishihara et al. ..... 376/272

(Continued)

FOREIGN PATENT DOCUMENTS

EP 0 628 968 A1 10/1993

(Continued)

OTHER PUBLICATIONS

Machine translation of JP 2003 -050295 and JP 2003-066189.*

(Continued)

*Primary Examiner*—Vasu Jagannathan
*Assistant Examiner*—Hannah Pak
(74) *Attorney, Agent, or Firm*—Trop, Pruner & Hu, P.C.

(57) ABSTRACT

There is provided a neutron shielding material which has heat resistance and has ensured neutron shielding performance even in a high-temperature environment during storage of a spent nuclear fuel for high burnup. A neutron shielding material having improved heat resistance and ensured neutron shielding performance due to the absence of an amine curing agent is provided by a neutron shielding material composition comprising a polymerization initiator, a polymerization component, a density increasing agent and a boron compound. As the polymerization component of the present invention, an epoxy component and an oxetane component are particularly preferably used.

19 Claims, 2 Drawing Sheets

U.S. PATENT DOCUMENTS

| | | | | |
|---|---|---|---|---|
| 2003/0102445 | A1* | 6/2003 | Kamoshida et al. | 250/507.1 |
| 2008/0039566 | A1* | 2/2008 | Hayashi et al. | 524/404 |

FOREIGN PATENT DOCUMENTS

| | | | |
|---|---|---|---|
| JP | 60-194394 | A1 | 2/1985 |
| JP | 6-148388 | A1 | 5/1994 |
| JP | 6-180389 | A1 | 6/1994 |
| JP | 2001-108787 | | 4/2001 |
| JP | 2001-116885 | A1 | 4/2001 |
| JP | 2001-215296 | | 10/2001 |
| JP | 2003-50295 | A1 | 2/2003 |
| JP | 2003-66189 | A1 | 3/2003 |
| JP | 2004-61463 | | 2/2004 |

OTHER PUBLICATIONS

Smith. "Can Magnesium Be Extracted from Sea Water." WiseGREEK, pp. 1-2, 2003.*

European Patent Office, Supplementary European Search Report, Oct. 7, 2008.

Japanese Patent Office, English Translation of Office Action issued in corresponding Japanese Patent Application No. 2001-253806, 6 pages, Dec. 8, 2009.

* cited by examiner

NEUTRON SHIELDING MATERIAL COMPOSITION, SHIELDING MATERIAL AND CONTAINER

TECHNICAL FIELD

The present invention relates to a neutron shielding material composition. Further, the present invention relates to a neutron shielding material composition that is a material applied to a cask as a container for storing and transporting a spent nuclear fuel, exhibits improved heat resistance and has ensured neutron shielding performance.

BACKGROUND ART

Nuclear fuels spent in nuclear facilities such as nuclear power plants are typically transported to reprocessing plants and then reprocessed. However, such spent nuclear fuels today are generated in an amount exceeding the reprocessing capacity. Thus, it is necessary to store spent nuclear fuels for a long period. In this case, spent nuclear fuels are cooled to a radioactivity level that makes the fuels suitable for transportation, and then placed in a cask as a nuclear shielding container and transported. Even at this stage, the spent nuclear fuels still emit radiation such as neutrons. Neutrons have high energy, and generate γ-rays to cause serious harm to the human body. For this reason, it is necessary to develop a material that surely shields such neutrons.

Neutrons are known to be absorbed by boron. To make boron absorb neutrons, it is necessary to slow down the neutrons. Hydrogen is known to be most suitable as a substance for slowing down neutrons. Accordingly, a neutron shielding material composition must contain a large amount of boron and hydrogen atoms.

Further, since spent nuclear fuels or the like as a neutron source generate decay heat, the fuels are heated to a high temperature when sealed for transportation or storage. Although the highest temperature varies depending upon the types of spent nuclear fuels, it is said that the temperature of spent nuclear fuels for high burnup may reach about 200° C. in a cask. For this reason, a nuclear shielding material for use preferably endures under such high-temperature conditions for about 60 years as a reference storage period for spent nuclear fuels.

In this situation, use of a substance having a high hydrogen density, in particular, water as a shielding material has been proposed, and some of the proposals have been put into practice. However, water is difficult to be handled because it is a liquid, and is not suitable for a cask for transportation and storage, in particular. Moreover, it is difficult to suppress boiling in a cask in which the temperature reaches 100° C. or more, disadvantageously.

Conventionally, a resin composition has been used as a material for a neutron shielding material, and an epoxy resin has been used in one of such resin compositions. Generally, there is a reciprocal relationship between hydrogen content and heat resistance in a resin composition. A resin composition having a high hydrogen content tends to have low heat resistance, and a resin composition having high heat resistance tends to have a low hydrogen content. An epoxy resin exhibits excellent heat resistance and curability, but tends to contain only a small amount of hydrogen indispensable for slowing down neutrons. Therefore, an amine curing agent having a high hydrogen content has been used to compensate this drawback.

Japanese Patent Laid-Open No. 6-148388 discloses a neutron shielding material composition which employs a polyfunctional amine epoxy resin to have reduced viscosity and improved workability at ordinary temperature and exhibits excellent pot life. Japanese Patent Laid-Open No. 9-176496 discloses a neutron shielding material obtained by curing a composition made of an acrylic resin, epoxy resin, silicone resin or the like with a polyamine curing agent.

Since an amine compound has a relatively high hydrogen content, the effect of absorbing neutrons is improved. However, the carbon-nitrogen bond contained in an amine curing agent is easily decomposed by heat. Accordingly, it has been demanded to develop a novel composition having durability necessary for storing a spent nuclear fuel for high burnup, rather than a conventional neutron shielding material made of a resin cured with an amine curing agent.

An object of the present invention is to provide a neutron shielding material composition which exhibits thermal durability improved as compared with a conventional composition, and surely absorbs neutrons.

DISCLOSURE OF THE INVENTION

The present invention provides a neutron shielding material composition comprising a polymerization initiator, a polymerization component, a density increasing agent and a boron compound. The present invention provides a neutron shielding material composition not comprising a curing agent. The composition preferably comprises an epoxy component as the polymerization component. The composition particularly preferably comprises a hydrogenated epoxy compound as the epoxy component. The hydrogenated epoxy compound herein refers to an epoxy compound having an increased hydrogen content obtained by hydrogenating at least part of a benzene ring to break conjugation of the part of the benzene ring but nevertheless maintain the cyclic structure. In the present invention, the epoxy component preferably comprises a compound of the structural formula (1):

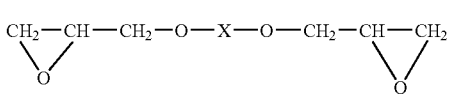

(1)

wherein X is at least one compound selected from compounds of the structural formulas (2), (3), (4), (5) and (6):

(2)

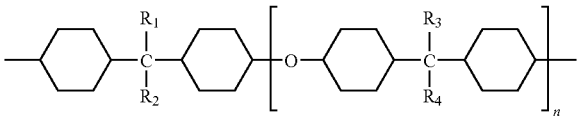

(3)

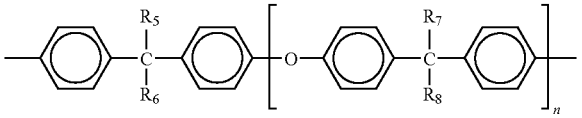

(4)

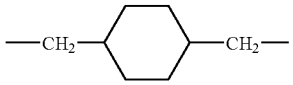

-continued (5)

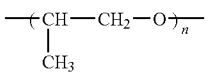

(6)

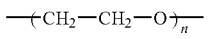

wherein $R_1$ to $R_4$ are each independently selected from the group consisting of $CH_3$, H, F, Cl and Br, and n is 0 to 2 in the structural formula (2), $R_5$ to $R_8$ are each independently selected from the group consisting of $CH_3$, H, F, Cl and Br, and n is 0 to 2 in the structural formula (3), n is 1 to 12 in the structural formula (5), and n is 1 to 24 in the structural formula (6).

The epoxy component preferably comprises a compound of the structural formula (14):

(14)

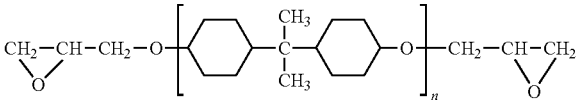

wherein n is 1 to 3. The epoxy component also preferably comprises at least one compound selected from the group consisting of compounds of the structural formulas (7), (8), (15), and (17):

(7)

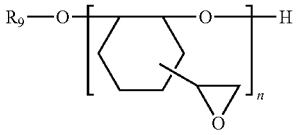

wherein $R_9$ is a C1-10 alkyl group or H, and n is 1 to 24; a compound of the structural formula (8):

(8)

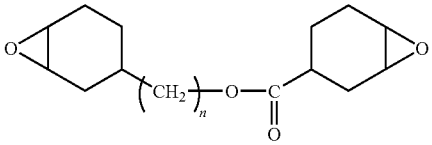

wherein n is 1 to 8; a compound of the structural formula (15)

(15)

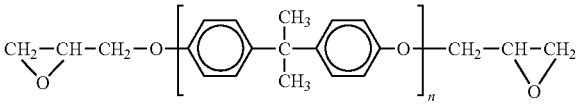

wherein n is 1 to 3; and a compound of the structural formula (17).

(17)

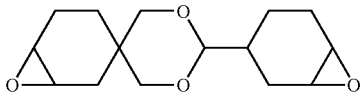

The neutron shielding material composition of the present invention preferably further comprises a compound for increasing the hydrogen content of the composition. The composition preferably comprises, as the compound for increasing the hydrogen content, at least one of compounds of the structural formulas (9) and (10):

(9)

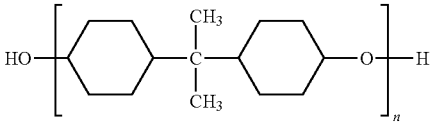

(10)

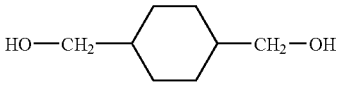

wherein n is 1 to 3.

The composition preferably comprises an oxetane compound as the polymerization component, and the oxetane compound preferably comprises at least one of compounds of the structural formulas (19) and (20).

(19)

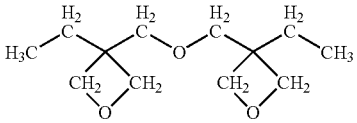

(20)

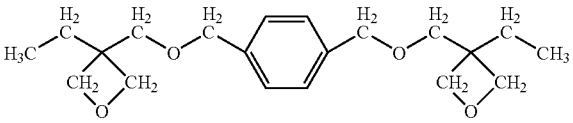

Further, the polymerization initiator preferably comprises a cationic polymerization initiator, and the cationic polymerization initiator preferably comprises a compound of the structural formula (11) or (16):

(11)

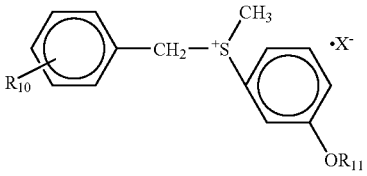

-continued (16)

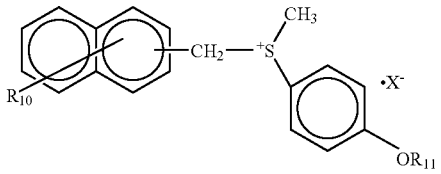

wherein $R_{10}$ is a hydrogen atom, a halogen atom, a nitro group or a methyl group, $R_{11}$ is a hydrogen atom, $CH_3CO$ or $CH_3OCO$, and X is $SbF_6$, $PF_6$, $BF_4$ or $AsF_6$.

The density increasing agent is preferably a metal powder having a density of 5.0 to 22.5 g/cm$^3$, a metal oxide powder having a density of 5.0 to 22.5 g/cm$^3$, or a combination thereof.

The neutron shielding material composition of the present invention preferably further comprises a filler, and preferably further comprises a refractory material. The refractory material preferably comprises at least one of magnesium hydroxide and aluminum hydroxide. Magnesium hydroxide is more preferably magnesium hydroxide obtained from sea water magnesium.

The present invention further provides a neutron shielding material and a neutron shielding container produced from the neutron shielding material composition.

Reaction in the composition of the present invention proceeds between a compound polymerizable by the action of a polymerization initiator, preferably an epoxy component, and a polymerization initiator, and the composition does not comprise an amine curing agent susceptible to heat. Thus, a cask using the composition of the present invention as a material has improved heat resistance. The composition also has a hydrogen content satisfying the standard, and has ensured neutron shielding performance. Further, since the composition of the present invention comprises a density increasing agent, the neutron shielding material can provide an increased neutron absorption while maintaining secondary γ-ray shielding performance, and accordingly can have improved neutron shielding performance without placing a structure for shielding γ-rays outside the main body of the neutron shielding material as in a conventional manner.

BEST MODE FOR CARRYING OUT THE INVENTION

Figure 1:
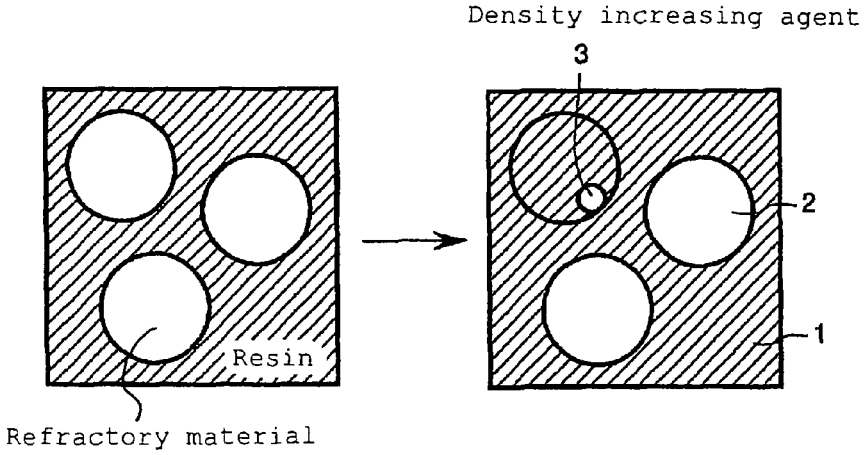
FIG. 1 is a conceptual view showing an embodiment of the neutron shielding material composition of the present invention.

Embodiments of the present invention will be described in detail below. The embodiments described below do not limit the present invention. Throughout the present invention, a polymerization component refers to a compound polymerizable by the action of a polymerization initiator. In particular, the composition of the present invention comprises, as polymerization components, an epoxy component and an oxetane component described below. An epoxy component refers to a compound having an epoxy ring (herein after referred to as epoxy compound), and may be one epoxy compound or a mixture of two or more epoxy compounds. Similarly, an oxetane compound refers to a compound having an oxetane ring, and may be one oxetane compound or a mixture of two or more oxetane compounds.

A resin component refers to a combination of a polymerization component as described above with a polymerization initiator component, and a combination of these components with a compound for increasing the hydrogen content, for example, a diol.

In the present invention, the composition can be cured without using a curing agent having an amine moiety susceptible to heat by adding a polymerization initiator component to a cationically polymerizable compound, in particular, an epoxy compound, an oxetane compound or both. A conventional composition employs an amine compound as a curing agent, and thus has decreased heat resistance, in particular, thermal decomposition resistance in a high-temperature condition for a long period. Since the composition of the present invention can be cured without use of such a curing agent, a resin having no carbon-nitrogen bond moiety in which the bond is easily decomposed in a high-temperature state can be obtained, and high heat resistance can be expected. Accordingly, since a decrease in heat resistance by use of a curing agent does not occur as in a conventional composition, the composition of the present invention can be provided with desired properties such as hydrogen content and heat resistance by selection of a polymerization component.

The composition of the present invention is preferably a composition having a high hydrogen content comprising a polymerization component, a polymerization initiator component, a density increasing agent, a boron compound as a neutron absorbent, and a refractory material, characterized in that the composition is cured to be a resin with high heat resistance and high neutron shielding effect. Specifically, the composition of the present invention is required to have a temperature of 330° C. or more, and preferably 350° C. or more for attaining a residual weight ratio of 90 wt % by thermogravimetric analysis of a cured product thereof, and to have a hydrogen content of preferably 9.0 wt % or more, and more preferably 9.8 wt % or more based on the total resin component. This is because, if the hydrogen content is 9.0 wt % or more, neutron shielding effect to be achieved can be ensured by controlling the amount of the refractory material.

In addition, more specifically, the cured product after thermal endurance in a high-temperature closed environment for a long period preferably has a weight reduction and compressive strength as small as possible. For example, the cured resin after thermal endurance in a closed environment at 190° C. for 1,000 hours is required to have a weight reduction of 0.5 wt % or less, and preferably 0.2 wt % or less, and to have compressive strength not reduced, and most preferably inclined to be increased instead.

As the polymerization component of the present invention, a compound having high heat resistance is preferably used. An epoxy compound is particularly preferably used, since the composition requires heat resistance at 100° C. or more, and preferably at about 200° C.

As the epoxy component of the present invention, a compound having an epoxy ring which can be polymerized using a cationic polymerization initiator component is used. To improve heat resistance, the epoxy component preferably has a high crosslinking density. In addition, when the epoxy component contains many ring structures, the compound has a rigid structure, and thus can improve heat resistance. Examples of the ring structure include a benzene ring. A benzene ring is rigid and has excellent heat resistance, but contains only a small amount of hydrogen that functions to slow down neutrons in the present invention. Thus, a compound with a hydrogenated benzene ring is more preferable. As a rigid structure having high heat resistance, a structure represented by the formula (12) is preferable.

(12)

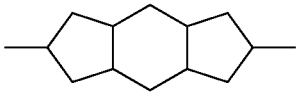

A structure represented by the formula (13) is most preferable, because such a rigid structure preferably has a higher hydrogen content.

(13)

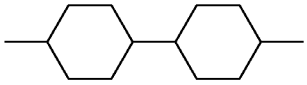

Throughout the present specification, such an epoxy compound having a ring structure in which a benzene ring is hydrogenated is referred to as a hydrogenated epoxy compound. A hydrogenated epoxy compound has a heat-resistant structure and a high hydrogen content, and is thus most preferable as the epoxy compound of the present invention.

The epoxy component may be one epoxy compound or a mixture of a plurality of epoxy compounds. An epoxy compound is selected so that the compound can impart desired properties such as increased heat resistance and hydrogen content.

The composition of the epoxy component is determined so that the resin component contains hydrogen in an amount sufficient for shielding neutrons, and preferably in an amount of preferably 9.0 wt % or more, and more preferably 9.8 wt % or more. Neutron shielding performance of the neutron shielding material is determined according to the hydrogen content (density) of the neutron shielding material and the thickness of the neutron shielding material. This value is based on the hydrogen content required for the resin component, which is calculated with respect to the hydrogen content (density) required for the neutron shielding material, determined from neutron shielding performance required for a cask and the designed thickness of the neutron shielding material in the cask, taking into consideration the amounts of the refractory material and the neutron absorbent added to the neutron shielding material and kneaded.

From this point of view, a compound having an epoxy ring, preferably a plurality of epoxy rings, which has a rigid structure or a ring structure represented by the structural formula (12) or (13) and has a high hydrogen content is suitable as the epoxy component of the present invention. Such an epoxy component is generally represented by the structural formula (1), wherein X is preferably selected from the structural formula (2), wherein $R_1$ to $R_4$ are each independently selected from the group consisting of $CH_3$, H, F, Cl and Br, and n is 0 to 2, the structural formula (3), wherein $R_5$ to $R_8$ are each independently selected from the group consisting of $CH_3$, H, F, Cl and Br, and n is 0 to 2, the structural formula (4) or (5), wherein n is 1 to 12, and the structural formula (6), wherein n is 1 to 24.

In particular, a hydrogenated bisphenol A epoxy represented by the structural formula (14) is used as a most suitable and important epoxy component to provide a hydrogen content and heat resistance in a well-balanced manner.

Further, a bisphenol A epoxy (structural formula (15)) may be added as a component for imparting heat resistance. This is because the compound has a benzene ring and a rigid structure. To increase crosslinking density and improve heat resistance, the structural formula (7), wherein $R_9$ is a C1-10 alkyl group or H, and n is 1 to 24, the structural formula (8), wherein n is 1 to 8, or the structural formula (19) is preferably added.

Accordingly, a mixture of the structural formula (14) with at least one compound selected from the group consisting of the structural formula (15), the structural formula (7), the structural formula (8) and the structural formula (17) can provide a compound having desired hydrogen content and heat resistance. Thus, the epoxy component of the present invention comprises an epoxy compound represented by the structural formula (14), and may comprise all or some of the structural formula (15), the structural formula (7), the structural formula (8) and the structural formula (17). Any possible combination using these epoxy compounds can be used.

In this case, the composition preferably comprises 70 wt % or more of a hydrogenated bisphenol A epoxy of the structural formula (14), 20 wt % or less of a bisphenol A epoxy of the structural formula (15), 30 wt % or less of the structural formula (7), 25 wt % or less of the structural formula (8) and 30 wt % or less of the structural formula (17), respectively based on the total resin content.

In particular, an oxetane compound can be used as the polymerization component to increase the hydrogen content. An oxetane compound can be cationically polymerized like an epoxy, has a high hydrogen content, and is expected to have certain heat resistance.

Generally, an oxetane compound is represented by the structural formula (18):

(18)

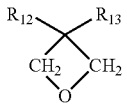

wherein $R_{12}$ and $R_{13}$ are each independently H, halogen, C1-8 alkyl, an alcohol, or another structure containing an organic compound composed of carbon, hydrogen and oxygen. The oxetane compound used in the present invention may be a compound having two or more oxetane rings through an ether bond or benzene ring.

Specifically, the oxetane compound used in the present invention is preferably the structural formula (19) or the structural formula (20). The oxetane compound is not limited thereto. A compound having at least two oxetane rings through, for example, an ether bond or ring structure like the structural formula (19) is preferable. This is because a compound containing many oxetane rings can be expected to impart heat resistance by increasing the crosslinking density. Further, an oxetane compound having many ring structures, branched structures or the like is preferable, since the composition of the present invention is particularly required to be provided with heat resistance.

An oxetane component may be used singly as the polymerization component without using an epoxy compound. Two or more oxetane compounds may be used. An oxetane component may be used as the polymerization component in combination with any epoxy component. Preferable examples of a combination of polymerization components include a combination of an oxetane component of the structural formula (19) with an epoxy component of the structural formula (7), a combination of an oxetane component of the structural formula (19) with an epoxy component of the structural formula (8), and a combination of an oxetane component of the structural formula (19) with an epoxy component of the structural formula (17).

In one example of a composition ratio of polymerization components using an oxetane compound, the structural formula (19) is 85.5 wt % and the structural formula (15) is 14.5 wt %. In another example, the structural formula (19) is 74.0 wt %, the structural formula (20) is 20.0 wt %, and the structural formula (7) is 6.0%.

Polymerization initiators are classified into radical polymerization initiators, anionic polymerization initiators, cationic polymerization initiators, and the like, and many of them are reported in documents or the like. In the present invention, cationic polymerization initiators are preferably used. Examples of well-known cationic polymerization initiators are shown in Table 1. Examples of cationic thermal polymerization initiators that can initiate polymerization by heat include Opton CP series of Asahi Denka Co., Ltd.; SI series of Sanshin Chemical Industry Co., Ltd.; and DAICAT EX-1 of Daicel Chemical Industries, Ltd. These polymerization initiators can be used, but are not exclusively used, in the present invention.

TABLE 1

General polymerization initiator components

| Structure | Product name | | Supplier |
|---|---|---|---|
| 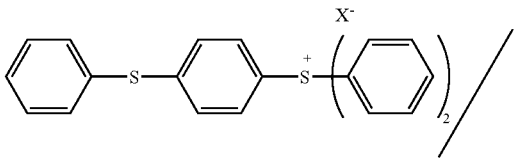 | X = $SbF_6$ UVI-6974 | | UCC |
| 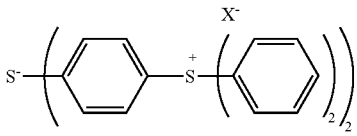 | X = $PF_6$ UVI-6990 | | UCC |
| 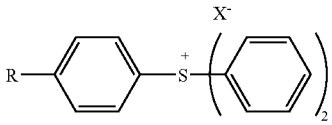 | X = $SbF_6$ UVI-6970 (SP-170) | X = $PF_6$ UVI-6950 (SP-150) | Asahi Denka |
| 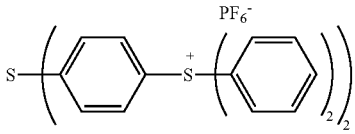 | Degacure K126 FX-512 | | Degussa 3M |
| 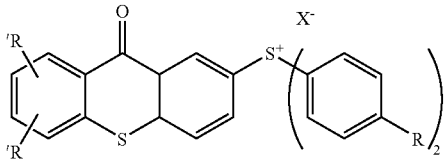 | X = $SbF_6$ PIC-061T | X = $PF_6$ PIC-062T | Nippon Kayaku |
| 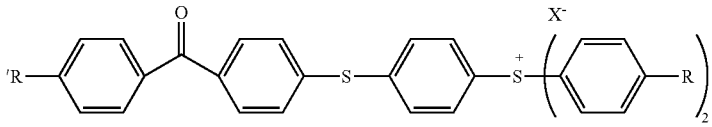 | X = $SbF_6$ PIC-020T | X = $PF_6$ PIC-022T | Nippon Kayaku |

TABLE 1-continued

| General polymerization initiator components | | |
|---|---|---|
| Structure | Product name | Supplier |
| 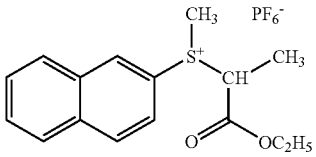 | Synthetic sulfonium salt | Nippon Soda |
| 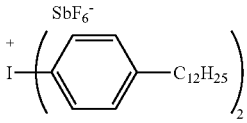 | UV-9380C | GE |
| 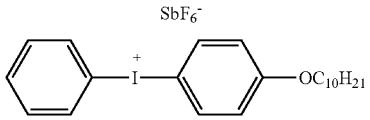 | IOC-10 | GE |
| 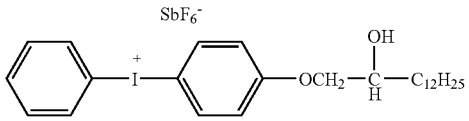 | CD-1012 | Sartomer |
| 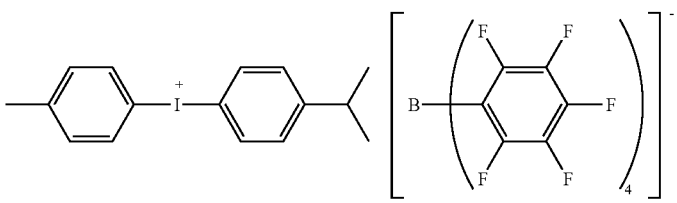 | 2074 | Rhone-Poulenc Chimie |
| 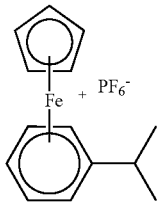 | Iruga-cure 261 | Chiba-Geigy |
| 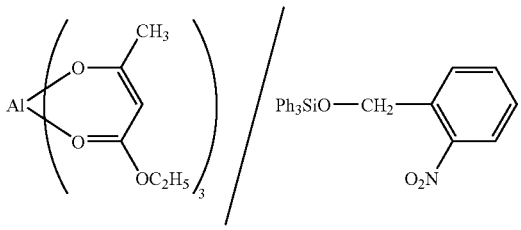 | | Toshiba |

As the polymerization initiator, a compound represented by the structural formula (11) or (16) is preferably added. The polymerization initiator is added in an amount of preferably 0.5 to 6 parts by weight, and more preferably 1 to 3 parts by weight based on 100 parts by weight of the total resin component. This is because, if the polymerization initiator is added too much, the hydrogen content in the total composition may be decreased.

Further, a compound that does not have an epoxy ring and contains a large amount of hydrogen may be added to the composition of the present invention to increase the hydrogen content. Such a compound may be optionally added when the hydrogen content is insufficient, since the hydrogen content cannot be indefinitely increased by an epoxy compound alone. Here, the compound to be added must be selected so that the compound does not significantly affect properties of the entire system of the composition. For example, when an amine compound is mixed with the composition of the present invention containing a cationic polymerization initiator, polymerization reaction of the epoxy component does not proceed. Therefore, an amine compound cannot be added. As a result of studies taking this point into consideration, a diol is suitable as a compound for increasing the hydrogen content, for example.

Any diol can be used insofar as it is soluble in the epoxy component and polymerizable with the epoxy component. Examples of the diol that can be used include, but are not limited to, an aliphatic diol, an aromatic diol, and a diol or polyol having an alicyclic structure. Preferably, a diol having an alicyclic structure, for example, a compound represented by the structural formula (9) or (10) is used in order to increase the hydrogen content and suppress a decrease in heat resistance. A diol is added in an amount of preferably 30 wt % or less, and more preferably 20 wt % or less based on the total resin component.

The compound for increasing the hydrogen content in the composition is not limited to a diol. A cationically curable oxetane or vinyl ether, a trifunctional or higher functional alcohol that can expected to have the same effect as in a diol, or the like can be used.

The density increasing agent may be any material that is dense and can increase the specific gravity of the neutron shield, unless the material adversely affects other components. Here, the density increasing agent itself which effectively shields γ-rays has a density of 5.0 g/cm$^3$ or more, preferably 5.0 to 22.5 g/cm$^3$, and more preferably 6.0 to 15 g/cm$^3$. If the density is 5.0 g/cm$^3$ or less, it is difficult to effectively shields γ-rays without impairing neutron shielding capability. If the density is 22.5 g/cm$^3$ or more, an effect in proportion to the amount added cannot be observed.

Specific examples of the density increasing agent include metal powders and metal oxide powders. Preferable examples of the density increasing agent include metals having a melting point of 350° C. or more such as Cr, Mn, Fe, Ni, Cu, Sb, Bi, U and W; and metal oxides having a melting point of 1,000° C. or more such as NiO, CuO, ZnO, $ZrO_2$, SnO, $SnO_2$, $WO_2$, $UO_2$, PbO, $WO_3$ and lanthanoid oxides. Of these, Cu, $WO_2$, $WO_3$, $ZrO_2$ and $CeO_2$ are particularly preferable. This is because they are advantageous in terms of cost. The density increasing agent may be used singly or in a mixture of two or more.

There are no specific limitations to the particle size of the density increasing agent. However, if the particle size is large, the density increasing agent may settle during production. Therefore, the particle size is preferably small to the extent that settling does not occur. The particle size that does not cause settling largely depends on other conditions (for example, the temperature, viscosity, curing speed and the like of the composition), and thus cannot be numerically defined simply.

By adding the density increasing agent, the specific gravity of the neutron shield can be increased, and γ-rays can be more effectively shielded. By use of the above-described metal powder or metal oxide powder, fire resistance can also be improved.

By replacing a part of an additive other than the resin component, mainly a part of the refractory material with the density increasing agent, the hydrogen content may be increased. By replacing mainly a part of the refractory material with the density increasing agent, the amount of the epoxy resin can be increased while maintaining the specific gravity of the neutron shielding material composition (1.62 to 1.72 g/cm$^3$). Thus, a neutron shield having a high hydrogen content can be produced, and neutrons can be effectively shielded. Specifically, neutron shielding capability and γ-ray shielding can be achieved at the same time.

The amount of the density increasing agent to be added can be appropriately adjusted to maintain the specific gravity of the above-described neutron shielding material composition (1.62 to 1.72 g/cm$^3$). It is difficult to specifically define the amount, because the amount varies according to the type of the density increasing agent used, the types and contents of other components, and the like. For example, the amount is 5 to 40 mass %, and preferably 9 to 35 mass % based on the total neutron shielding material composition. The amount is particularly preferably 15 to 20 mass % when using $CeO_2$. If the amount is 5 mass % or less, it is difficult to observe the effect of adding the density increasing agent. If the amount is 40 mass % or more, it is difficult to maintain the specific gravity of the neutron shielding material composition at 1.62 to 1.72 g/cm$^3$.

Examples of a boron compound used as the neutron absorbent in the composition of the present invention include boron carbide, boron nitride, boric acid anhydride, boron iron, colemanite, orthoboric acid and metaboric acid. Boron carbide is most preferable in terms of neutron shielding performance.

The above-described boron compound is used as a powder without specific limitations to its particle size and amount added. However, taking dispersibility in the epoxy resin of the matrix resin and neutron shielding performance into consideration, the average particle size is preferably about 1 to 200 microns, more preferably about 10 to 100 microns, and particularly preferably about 20 to 50 microns. On the other hand, the amount of the boron compound added is most preferably 0.5 to 20 wt % based on the total composition including the filler described below. If the amount is less than 0.5 wt %, the boron compound added exhibits only a small effect as the neutron shielding material. If the amount is more than 20 wt %, it is difficult to homogeneously disperse the boron compound.

In the present invention, a powder of silica, alumina, calcium carbonate, antimony trioxide, titanium oxide, asbestos, clay, mica or the like; a glass fiber; or the like is used as the filler. A carbon fiber or the like may be added if necessary. Further, if necessary, a natural wax, fatty acid metal salt, acid amide, fatty acid ester or the like as a releasing agent; paraffin chloride, bromotoluene, hexabromobenzene, antimony trioxide or the like as a flame retardant; carbon black, iron oxide red or the like as a colorant; a silane coupling agent; a titanium coupling agent; or the like can be added.

The refractory material used in the composition of the present invention aims to preserve a certain amount or more of the neutron shielding material so that neutron shielding capability can be maintained to a certain extent or higher even in case of fire. As such a refractory material, magnesium hydroxide or aluminum hydroxide is particularly preferable. Of these, magnesium hydroxide is particularly preferable, because it is present in a stable manner even at a high temperature of about 200° C. Magnesium hydroxide is preferably magnesium hydroxide obtained from sea water magnesium. This is because magnesium in sea water has a high purity to make the hydrogen ratio in the composition relatively high. Sea water magnesium can be produced by a method such as a sea water method or ionic brine method. Otherwise, a commercially available product Kisuma 2SJ (product name, Kyowa Chemical Industry Co., Ltd.) may be purchased and used. However, commercially available magnesium hydroxide is not limited to this product. The refractory material is added in an amount of preferably 20 to 70 wt %, and particularly preferably 35 to 60 wt % based on the total composition.

The composition of the present invention is prepared by mixing a polymerization component, for example, an epoxy component with other additives to prepare a resin composition; kneading the resin composition with a refractory material, a neutron absorbent or the like; and finally adding a polymerization initiator. Although polymerization conditions differ according to the composition of the resin component, heating is preferably carried out at a temperature of 50° C. to 200° C. four 1 to 3 hours. Further, such heating treatment is preferably carried out in two stages. It is preferable to carry out heating treatment at 80° C. to 120° C. for 1 to 2 hours, and then at 120° C. to 180° C. four 2 to 3 hours. However, the preparation method, curing conditions and the like are not limited thereto.

Further, a container, preferably a cask, for effectively shielding neutrons in a spent nuclear fuel and storing and transporting the spent nuclear fuel can be produced. Such a transportation cask can be produced utilizing a known technology. For example, in a cask disclosed in Japanese Patent Laid-Open No. 2000-9890, a location to be filled with a neutron shield is provided. Such a location can be filled with the composition of the present invention.

The composition of the present invention can be used not only for such a shield, but also for various places in apparatuses and facilities to prevent diffusion of neutrons, and can effectively shield neutrons.

Specific examples of embodiments of the present invention using a resin component, a density increasing agent and a refractory material will be further described in detail with reference with the drawings. Here, embodiments in which a boron compound or a filler is not added will be described for illustration. However, the present invention is not limited to such embodiments.

First Embodiment

FIG. 1 is a conceptual view showing a configuration example of the neutron shield of the present embodiment. Specifically, as shown in FIG. 1, the neutron shield of the present embodiment is obtained by mixing a resin component 1 comprising a polymerization component and a polymerization initiator as main components with a refractory material 2 and a density increasing agent 3 having a density higher than in the refractory material 2.

Here, the neutron shield is provided with an increased hydrogen content while maintaining the material density (in the range of 1.62 to 1.72 g/mL), by mixing a metal powder or metal oxide powder as the density increasing agent 3, in particular. The density increasing agent 3 to be mixed has a density of 5.0 g/mL or more, preferably 5.0 to 22.5 g/mL, and more preferably 6.0 to 15 g/mL. Further, the density increasing agent 3 to be mixed is preferably a metal powder having a melting point of 350° C. or more or a metal oxide powder having a melting point of 1,000° C. or more. Examples of a powder material corresponding to the density increasing agent include metals such as Cr, Mn, Fe, Ni, Cu, Sb, Bi, U and W. Further examples thereof include metal oxides such as NiO, CuO, ZnO, $ZrO_2$, SnO, $SnO_2$, $WO_2$, $CeO_2$, $UO_2$, PbO, PbO, and $WO_3$.

Since the neutron shield of the present embodiment configured as above is prepared by mixing the resin component 1 comprising a polymer as a main component, the refractory material 2, and the density increasing agent 3 having a density higher than in the refractory material 2, the neutron shield can have an increased hydrogen content while maintaining the material density at a certain value (in the range of 1.62 to 1.72 g/mL). Specifically, the refractory material 2 has a slightly higher density and a slightly lower hydrogen content as compared with the neutron shielding material 1. Thus, a part of the refractory material 2 is replaced with the density increasing agent 3 not containing hydrogen to make the material density equal. By calculating the density and the hydrogen content of each component and carrying out appropriate replacement, the refractory material 2 having a slightly lower hydrogen content is replaced with the resin component 1 having a high hydrogen content, so that the neutron shield can have an increased hydrogen content.

As a result, the neutron shield can provide an increased neutron absorption while maintaining secondary γ-ray shielding performance, and accordingly can have improved neutron shielding performance without placing a structure for shielding γ-rays outside the main body of the neutron shield as in a conventional manner.

In the neutron shield of the present embodiment, the density increasing agent 3 to be mixed has a density of 5.0 g/mL or more, preferably 5.0 to 22.5 g/mL, and more preferably 6.0 to 15 g/mL. Therefore, the neutron shield can exhibit the above-described effect more significantly.

Figure 2:
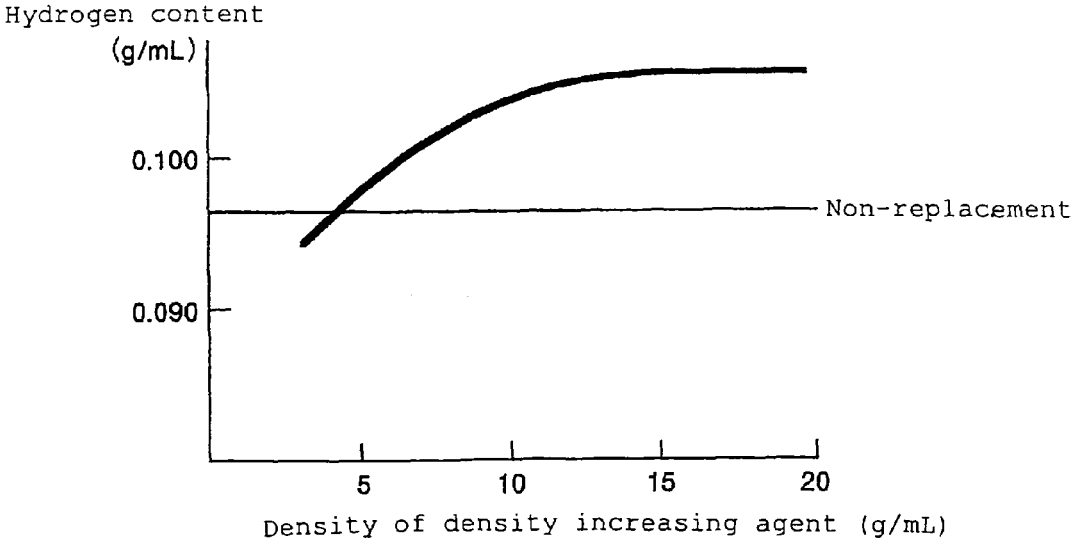
FIG. 2 is a characteristic view showing the relation between the density increasing agent and the hydrogen content in the neutron shielding material composition of the present invention.

FIG. 2 is a characteristic view showing the relation between the density of the density increasing agent 3 and the hydrogen content. FIG. 2 shows a hydrogen content of the neutron shield originally having a hydrogen content of 0.0969 g/mL, containing magnesium hydroxide as the refractory material 2 and containing the resin component 1 having a density of 1.64 g/mL, in which the refractory material 2 is replaced with the density increasing agent 3 to make the material density constant. Magnesium hydroxide as the refractory material 2 has a density of 2.36 g/mL. As is clear from FIG. 2, the density increasing agent 3 is effective only if the density of the density increasing agent 3 reaches a density slightly higher than in the refractory material 2, not the density of the refractory material 2, although the effective density differs according to the resin component 1 and the refractory material 2. Specifically, the density increasing agent 3 is effective at a density of 5.0 g/mL or more, and preferably 6.0 g/mL or more. If the density is 22.5 g/mL or more, an effect in proportion to the amount added cannot be observed.

Figure 3:
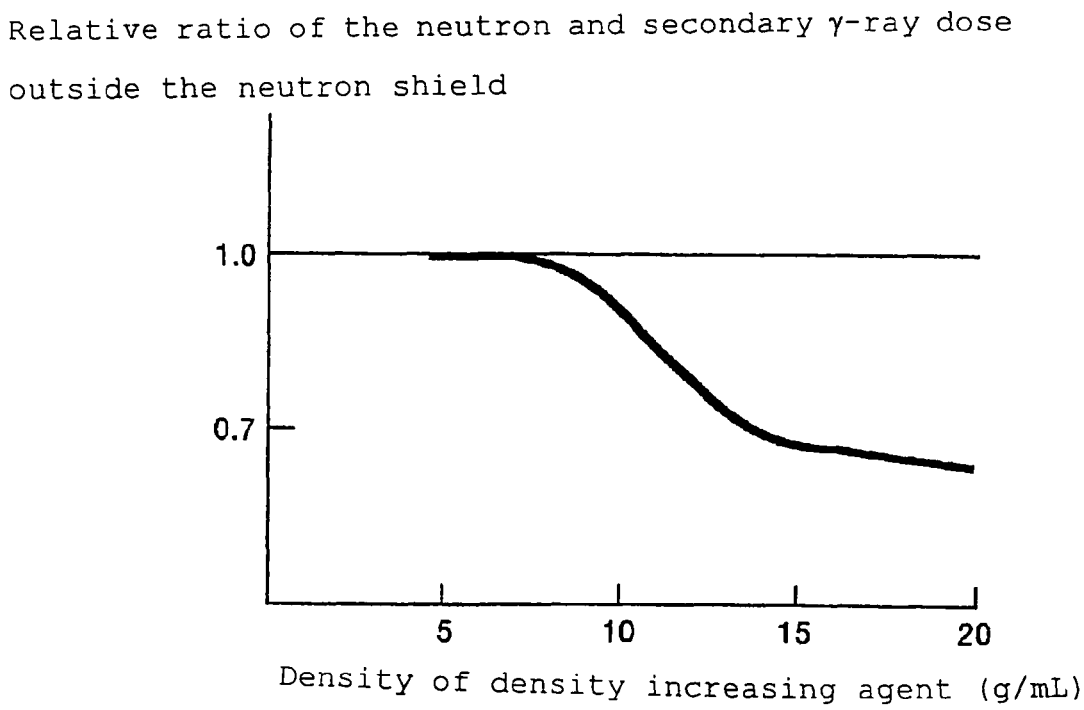
FIG. 3 is a characteristic view showing the relation between the density of the density increasing agent and the relative ratio of the neutron and secondary γ-ray dose outside the neutron shield in the present invention.

FIG. 3 is a characteristic view showing the relation between the density of the density increasing agent 3 and the relative ratio of the neutron and secondary γ-ray dose outside the neutron shield. FIG. 3 shows a shielding effect of the neutron shield originally having a hydrogen content of 0.0969 g/mL, containing magnesium hydroxide as the refractory material 2 and containing the base resin 1 having a density of 1.64 g/mL, in which the refractory material 2 is replaced with the density increasing agent 3 to make the material density constant. The dose outside the shield of the resin component 1 is defined as "1". As is clear from FIG. 3, the effect can be observed when the density increasing agent 3 has a density of 5.0 g/mL or more, and more preferably 6.0 g/mL or more. If the density is 22.5 g/mL or more, an effect in proportion to the amount added cannot be observed.

Further, the neutron shield of the present embodiment can be provided with improved fire resistance by mixing a metal powder having a melting point of 350° C. or more (such as Cr, Mn, Fe, Ni, Cu, Sb, Bi, U or W) or a metal oxide powder having a melting point of 1,000° C. or more (such as NiO, CuO, ZnO, $ZrO_2$, SnO, $SnO_2$, $WO_2$, $CeO_2$, $UO_2$, PbO, PbO or $WO_3$).

As described above, the neutron shield of the present embodiment can have an increased hydrogen content while maintaining the material density at a certain value without any decrease, and accordingly can have improved neutron shielding performance without placing a structure for shielding γ-rays outside the main body of the neutron shield as in a conventional manner.

Second Embodiment

As shown in the above FIG. 1, the neutron shield of the present embodiment is obtained by mixing an epoxy component and a polymerization initiator as a resin component 1 with a refractory material 2 and a density increasing agent 3 having a density higher than in the refractory material 2, and forming the mixture by curing.

The density increasing agent 3 to be mixed has a density of 5.0 g/mL or more, preferably 5.0 to 22.5 g/mL, and more preferably 6.0 to 15 g/mL. Further, the density increasing agent 3 to be mixed is preferably a metal powder having a melting point of 350° C. or more or a metal oxide powder having a melting point of 1,000° C. or more. Examples of a powder material corresponding to the density increasing agent include metals such as Cr, Mn, Fe, Ni, Cu, Sb, Bi, U and W. Further examples thereof include metal oxides such as NiO, CuO, ZnO, $ZrO_2$, SnO, $SnO_2$, $WO_2$, $CeO_2$, $UO_2$, PbO, PbO, and $WO_3$.

Since the neutron shield of the present embodiment configured as above is prepared by mixing the resin component 1, the refractory material 2, and the density increasing agent 3 having a density higher than in the refractory material 2, the neutron shield can have an increased hydrogen content while maintaining the material density at a certain value (in the range of 1.62 to 1.72 g/mL). Specifically, the refractory material 2 has a slightly higher density and a slightly lower hydrogen content as compared with the resin component 1. Thus, apart of the refractory material 2 is replaced with the density increasing agent 3 not containing hydrogen to make the material density equal. By calculating the density and the hydrogen content of each component and carrying out appropriate replacement, the refractory material 2 having a slightly lower hydrogen content is replaced with the resin component 1 having a high hydrogen content, so that the neutron shield can have an increased hydrogen content.

As a result, the neutron shield can provide an increased neutron absorption while maintaining secondary γ-ray shielding performance, and accordingly can have improved neutron shielding performance without placing a structure for shielding γ-rays outside the main body of the neutron shielding material as in a conventional manner.

In the neutron shielding material of the present embodiment, the density increasing agent 3 to be mixed has a density of 5.0 g/mL or more, preferably 5.0 to 22.5 g/mL, and more preferably 6.0 to 15 g/mL. Therefore, the neutron shielding material can exhibit the above-described effect more significantly.

FIG. 2 is a characteristic view showing the relation between the density of the density increasing agent 3 and the hydrogen content. FIG. 2 shows a hydrogen content of the neutron shield originally having a hydrogen content of 0.0969 g/mL, containing magnesium hydroxide as the refractory material 2 and containing the base resin 1 having a density of 1.64 g/mL, in which the refractory material 2 is replaced with the density increasing agent 3 to make the material density constant. Magnesium hydroxide as the refractory material 2 has a density of 2.36 g/mL. As is clear from FIG. 2, the density increasing agent 3 is effective only if the density of the density increasing agent 3 reaches a density slightly higher than in the refractory material 2, not the density of the refractory material 2, although the effective density differs according to the base resin 1 and the refractory material 2. Specifically, the density increasing agent 3 is effective at a density of 5.0 g/mL or more, and more preferably 6.0 g/mL or more. If the density is 22.5 g/mL or more, an effect in proportion to the amount added cannot be observed.

FIG. 3 is a characteristic view showing the relation between the density of the density increasing agent 3 and the relative ratio of the neutron and secondary γ-ray dose outside the neutron shield. FIG. 3 shows a shielding effect of the neutron shield originally having a hydrogen content of 0.0969 g/mL, containing magnesium hydroxide as the refractory material 2 and containing the base resin 1 having a density of 1.64 g/mL, in which the refractory material 2 is replaced with the density increasing agent 3 to make the material density constant. The dose outside the shield of the base resin 1 is defined as "1". As is clear from FIG. 3, the effect can be observed when the density increasing agent 3 has a density of 5.0 g/mL or more, and preferably 6.0 g/mL or more. If the density is 22.5 g/mL or more, an effect in proportion to the amount added cannot be observed.

Further, the neutron shield of the present embodiment can be provided with improved fire resistance by mixing a metal powder having a melting point of 350° C. or more (such as Cr, Mn, Fe, Ni, Cu, Sb, Bi, U or W) or a metal oxide powder having a melting point of 1,000° C. or more (such as NiO, CuO, ZnO, $ZrO_2$, SnO, $SnO_2$, $WO_2$, $CeO_2$, $UO_2$, PbO, PbO or $WO_3$).

As described above, the neutron shield of the present embodiment also can have an increased hydrogen content while maintaining the material density at a certain value without any decrease, and accordingly can have improved neutron shielding performance without placing a structure for shielding γ-rays outside the main body of the neutron shield as in a conventional manner. Specifically, since the neutron shield can be more effective for shielding neutrons while maintaining γ-ray shielding performance by use of a density increasing agent, it can be less necessary to place a heavy structure for shielding γ-rays outside the main body of the neutron shield as in a conventional manner.

EXAMPLES

The present invention will be described in detail below by way of examples. The examples below do not limit the present invention.

In the examples, the composition of the present invention was prepared, and the neutron shielding effect was examined. Typically, a resin composition for a neutron shielding material is mixed with copper as a density increasing agent, aluminum hydroxide or magnesium hydroxide as a refractory material, and a boron compound such as boron carbide as a neutron absorbent, respectively in an amount of about 20 wt %, about 40 wt % and about 1 wt % based on the total resin composition to prepare a neutron shield. However, compositions with a refractory material and a neutron absorbent not added are mainly described here in order to evaluate properties exhibited by a resin component, specifically, a polymerization component, a polymerization initiator component and the like, and a density increasing agent.

Properties required for the neutron shielding material include heat resistance (residual weight ratio, compressive strength, or the like), fire resistance and hydrogen content (the material must have a certain hydrogen content density or higher in order to be judged suitable for a neutron shield). Since fire resistance largely depends upon the refractory material, the resin composition for a neutron shielding material was evaluated for its heat resistance represented by a residual weight ratio and hydrogen content. The residual weight ratio was determined by measuring the weight change during heating to evaluate heat resistance of the composition. TGA was used for the measurement. The weight reduction by heat was measured under a condition where the composition was heated from room temperature to 600° C. at a rate of temperature rise of 10° C./min in a nitrogen atmosphere. A hydrogen content in a single resin of 9.8 wt % or more was defined as the standard hydrogen content required for the resin.

Example 1

1 g of a cationic polymerization initiator SI-80 (structural formula (11)) was added to 100 g of a hydrogenated bisphenol A epoxy resin (manufactured by Yuka Shell Epoxy K.K., YL6663 (structural formula (14)). The mixture was sufficiently stirred until the polymerization initiator was dissolved, and then mixed with 50 g of copper having a density of 8.92 g/cm$^3$ as a density increasing agent to prepare a resin composition used for a neutron shielding material.

As a result of measuring the hydrogen content in the resin composition for a neutron shielding material, the hydrogen content was 9.8 wt % or more (about 10 wt % or more) which satisfied the standard. Next, the composition was cured at 80° C. for 30 minutes and at 150° C. for 2 hours, and the weight reduction by heat of the cured product was measured by TGA. The weight reduction by heat was measured under a condition where the composition was heated from RT to 600° C. at a rate of temperature rise of 10° C./min in a nitrogen atmosphere. As a result of measurement, the residual weight ratio at 200° C. was 99.5 wt % or more, and the temperature at a residual weight ratio of 90 wt % was 350° C. or more, meaning that the composition exhibited extremely good heat resistance and heat stability.

Example 2

1 g of a cationic polymerization initiator SI-80 (structural formula (11)) was added to a mixture of 84.6 g of a hydrogenated bisphenol A epoxy resin (YL6663, structural formula (14)) and 15.4 g of a bisphenol A epoxy resin (manufactured by Yuka Shell Epoxy K.K., Epicoat 828, structural formula (15)) as epoxy resins. The mixture was sufficiently stirred until the polymerization initiator was dissolved, and then mixed with 50 g of copper as a density increasing agent to prepare a resin composition used for a neutron shielding material.

As a result of measuring the hydrogen content in the resin composition in the same manner as in Example 1, the hydrogen content was about 9.8 wt % which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was 99.5 wt % or more, and the temperature at a residual weight ratio of 90 wt % was 380° C. or more, meaning that the composition exhibited extremely good heat resistance and heat stability.

Example 3

74.8 g of a hydrogenated bisphenol A epoxy resin (YL6663, structural formula (14)) and 25.2 g of a polyfunctional alicyclic epoxy resin (manufactured by Daicel Chemical Industries, Ltd., EHPE3150, structural formula (7)) were mixed as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture was lowered to about room temperature, 1 g of a cationic polymerization initiator SI-80 (structural formula (11)) was added, and the mixture was sufficiently stirred until the polymerization initiator was dissolved. 50 g of copper was mixed therewith as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was about 99.5 wt %, and the temperature at a residual weight ratio of 90 wt % was 390° C. or more, meaning that the composition exhibited extremely good heat resistance and heat stability.

Example 4

1 g of a cationic polymerization initiator SI-80 (structural formula (11)) was added to a mixture of 79.4 g of a hydrogenated bisphenol A epoxy resin (YL6663, structural formula (14)) and 20.6 g of an alicyclic epoxy resin (manufactured by Daicel Chemical Industries, Ltd., Celloxide 2021P, structural formula (8)) as epoxy resins. The mixture was sufficiently stirred until the polymerization initiator was dissolved, and then mixed with 50 g of copper as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was 99.5 wt % or more, and the temperature at a residual weight ratio of 90 wt % was 370° C. or more, meaning that the composition exhibited extremely good heat resistance and heat stability.

Example 5

1 g of a cationic polymerization initiator SI-80 (structural formula (11)) was added to a mixture of 8.23 g of a hydrogenated bisphenol A epoxy resin (YL6663, structural formula (14)), 8.85 g of a bisphenol A epoxy resin (Epicoat 828, structural formula (15)) and 8.85 g of an alicyclic epoxy resin (Celloxide 2021P, structural formula (8)) as epoxy resins. The mixture was sufficiently stirred until the polymerization initiator was dissolved, and then mixed with 50 g of copper as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was 99.5 wt % or more, and the temperature at a residual weight ratio of 90 wt % was 380° C. or more, meaning that the composition exhibited extremely good heat resistance and heat stability.

Example 6

80.9 g of a hydrogenated bisphenol A epoxy resin (YL6663, structural formula (14)), 9.55 g of a bisphenol A epoxy resin (Epicoat 828, structural formula (15)) and 9.55 g of a polyfunctional alicyclic epoxy resin (EHPE3150, structural formula (7)) were mixed as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture was lowered to about room temperature, 1 g of a cationic polymerization initiator SI-80 (structural formula (11)) was added, and the mixture was sufficiently stirred until the polymerization initiator was dissolved. 50 g of copper was mixed therewith as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was 99.5 wt % or more, and the temperature at a residual weight ratio of 90 wt % was 390° C. or more, meaning that the composition exhibited extremely good heat resistance and heat stability.

Example 7

77.3 g of a hydrogenated bisphenol A epoxy resin (YL6663, structural formula (14)), 11.35 g of an alicyclic epoxy resin (Celloxide 2021P, structural formula (8)) and 11.35 g of a polyfunctional alicyclic epoxy resin (EHPE3150, structural formula (7)) were mixed as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture was lowered to about room temperature, 1 g of a cationic polymerization initiator SI-80 (structural formula (11)) was added, and the mixture was sufficiently stirred until the polymerization initiator was dissolved. 50 g of copper was mixed therewith as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat. As a result, the residual weight ratio at 200° C. was 99.5 wt % or more, and the temperature at a residual weight ratio of 90 wt % was 390° C. or more, meaning that the composition exhibited extremely good heat resistance and heat stability.

Example 8

80.38 g of a hydrogenated bisphenol A epoxy resin (YL6663, structural formula (14)), 6.54 g of a bisphenol A epoxy resin (Epicoat 828, structural formula (15)), 6.54 g of an alicyclic epoxy resin (Celloxide 2021P, structural formula (8)) and 6.54 g of a polyfunctional alicyclic epoxy resin (EHPE3150, structural formula (7)) were mixed as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture was lowered to about room temperature, 1 g of a cationic polymerization initiator SI-80 (structural formula (11)) was added, and the mixture was sufficiently stirred until the polymerization initiator was dissolved. 50 g of copper was mixed therewith as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was 99.5 wt % or more, and the temperature at a residual weight ratio of 90 wt % was 400° C. or more, meaning that the composition exhibited extremely good heat resistance and heat stability.

Example 9

63.8 g of a hydrogenated bisphenol A epoxy resin (YL6663, structural formula (14)), 26.2 g of an alicyclic epoxy resin (Celloxide 2021P, structural formula (8)) as epoxy resins were mixed with 10 g of a hydrogenated bisphenol (manufactured by New Japan Chemical Co., Ltd., Rikabinol HB, structural formula (9)). The mixture was maintained at 100° C. and sufficiently stirred until Rikabinol HB (solid) was dissolved. After dissolution of Rikabinol HB, the mixture was allowed to stand in an environment at room temperature. When the temperature of the mixture was lowered to about room temperature, 1 g of a cationic polymerization initiator SI-80 (structural formula (11)) was added, and the mixture was sufficiently stirred until the polymerization initiator was dissolved. 50 g of copper was mixed therewith as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was about 99.5 wt %, and the temperature at a residual weight ratio of 90 wt % was 380° C. or more, meaning that the composition exhibited extremely good heat resistance and heat stability.

Example 10

66.1 g of a hydrogenated bisphenol A epoxy resin (YL6663, structural formula (14)) and 23.9 g of an alicyclic epoxy resin (Celloxide 2021P, structural formula (8)) as epoxy resins were mixed with 10 g of cyclohexanedimethanol (manufactured by Tokyo Chemical Industry Co., Ltd., structural formula (10)). The mixture was maintained at 100° C. and sufficiently stirred until cyclohexanedimethanol (wax) was dissolved. After dissolution of cyclohexanedimethanol, the mixture was allowed to stand in an environment at room temperature. When the temperature of the mixture was lowered to about room temperature, 1 g of a cationic polymerization initiator SI-80 (structural formula (11)) was added, and the mixture was sufficiently stirred until the polymerization initiator was dissolved. 50 g of copper was mixed therewith as a density increasing agent to prepare a resin composition used for a neutron shielding material.

As a result of measuring the hydrogen content in the resin composition, the hydrogen content was about 9.8 wt % which satisfied the standard. On the other hand, the resin composition for a neutron shielding material was cured at 80° C. for 30 minutes and at 150° C. for 2 hours to measure the weight reduction by heat. As a result, the residual weight ratio at 200° C. was about 99.5 wt %, and the temperature at a residual weight ratio of 90 wt % was 380° C. or more, meaning that the composition exhibited extremely good heat resistance and heat stability.

Example 11

Here, evaluation was carried out for a neutron shielding material prepared by further mixing a neutron absorbent and a refractory material. 80.38 g of a hydrogenated bisphenol A epoxy resin (YL6663, structural formula (14)), 6.54 g of a bisphenol A epoxy resin (Epicoat 828, structural formula (15)), 6.54 g of an alicyclic epoxy resin (Celloxide 2021P, structural formula (8)) and 6.54 g of a polyfunctional alicyclic epoxy resin (EHPE3150, structural formula (7)) were mixed as epoxy resins. The mixture was maintained at 110° C. and sufficiently stirred until EHPE3150 (solid) was dissolved. After dissolution of EHPE3150, 39.0 g of copper as a density increasing agent, 76.0 g of magnesium hydroxide and 3.0 g of boron carbide were mixed therewith, and the mixture was stirred and maintained at 170° C. for 2 hours. After maintaining at 170° C. for 2 hours, the mixture was allowed to stand in an environment at room temperature. When the temperature of the mixture was about room temperature, 2 g of a cationic polymerization initiator SI-80 (structural formula (11)) was added, and the mixture was sufficiently stirred to prepare a neutron shielding material composition.

The reference hydrogen content required for a neutron shielding material is a hydrogen content density of 0.096 g/cm$^3$ or more. The hydrogen content density of the prepared neutron shielding material composition was measured to be 0.096 g/cm$^3$ or more, which satisfied the standard. The hydrogen content in the resin component was separately measured to be 9.8 wt % or more. On the other hand, the resin composition for a neutron shielding material was cured at 170° C. for 4 hours to measure the weight reduction by heat in the same manner as in Example 1. As a result, the residual weight ratio at 200° C. was 99.5 wt % or more, and the temperature at a residual weight ratio of 90 wt % was 400° C. or more, meaning that the composition exhibited extremely good heat resistance and heat stability. The cured product was enclosed in a closed vessel, and a thermal endurance test was carried out at 190° C. for 1,000 hours. The compressive strength was 1.4 times or more of that before the test, and the weight reduction was about 0.1%, meaning that the composition exhibited extremely good durability.

Example 12

63.8 g of a hydrogenated bisphenol A epoxy resin (YL6663, structural formula (14)), 26.2 g of an alicyclic epoxy resin (Celloxide 2021P, structural formula (8)) as epoxy resins were mixed with 10 g of a hydrogenated bisphenol (Rikabinol HB, structural formula (9)). The mixture was maintained at 100° C. and sufficiently stirred until Rikabinol HB (solid) was dissolved. After dissolution of Rikabinol HB, 39.0 g of copper as a density increasing agent, 76.0 g of magnesium hydroxide and 3.0 g of boron carbide were mixed therewith, and the mixture was stirred and maintained at 170° C. for 2 hours. After maintaining at 170° C. for 2 hours, the mixture was allowed to stand in an environment at room temperature. When the temperature of the mixture was about room temperature, 2 g of a cationic polymerization initiator SI-80L (structural formula (11)) was added, and the mixture was sufficiently stirred to prepare a neutron shielding material composition.

The reference hydrogen content required for a neutron shielding material is a hydrogen content density of 0.096 g/cm$^3$ or more. The hydrogen content density of the prepared neutron shielding material composition was measured to be 0.096 g/cm$^3$ or more, which satisfied the standard. On the other hand, the resin composition for a neutron shielding material was cured at 170° C. for 4 hours to measure the weight reduction by heat. As a result, the residual weight ratio at 200° C. was about 99.5 wt %, and the temperature at a residual weight ratio of 90 wt % was 380° C. or more, meaning that the composition exhibited extremely good heat resistance and heat stability. The cured product was enclosed in a closed vessel, and a thermal endurance test was carried out at 200° C. for 500 hours. The compressive strength was 1.2 times or more of that before the test, and the weight reduction was about 0.1%, meaning that the composition exhibited extremely good durability.

Next, performance of neutron shielding materials employing a conventionally used composition not containing a density increasing agent was evaluated. A refractory material or neutron absorbent was not added as in Examples. The hydrogen content was determined by component analysis, and the weight reduction by heat was determined by measurement using TGA.

Comparative Example 1

82.5 g of a hydrogenated bisphenol A epoxy resin as in Example 1 represented by the structural formula (14) (Yuka Shell Epoxy K.K., YL6663) as an epoxy resin and 17.5 g of isophoronediamine as a curing agent were sufficiently stirred to prepare a resin composition used for a neutron shielding material. This is a comparative example in which the present invention is compared with a neutron absorbent employed a curing agent. A density increasing agent was not added.

As a result of measuring the hydrogen content in the resin composition, the hydrogen content was 9.8 wt % or more which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was about 99.5 wt %, and the temperature at a residual weight ratio of 90 wt % was about 300° C., meaning that the composition exhibited heat resistance and heat stability inferior to those of the compositions of Examples.

This composition system considerably differs from that in Example 1 in that an amine curing agent is used instead of a cationic polymerization initiator. As is clear from comparison of the composition of Example 1 with the composition of Comparative Example 1, heat resistance and heat stability are improved by curing with a polymerization initiator as in Example 1.

Comparative Example 2

81.4 g of a bisphenol A epoxy resin (Epicoat 828, structural formula (15)) as an epoxy resin and 18.6 g of isophoronediamine as a curing agent were sufficiently stirred to prepare a resin composition used for a neutron shielding material. A density increasing agent was not added.

As a result of measuring the hydrogen content in the resin composition, the hydrogen content was 8.2 wt % or less which was considerably below the standard, unsatisfactorily. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was about 99.5 wt %, and the temperature at a residual weight ratio of 90 wt % was about 350° C., meaning that the composition exhibited good heat resistance and heat stability.

This composition system has good heat resistance and heat stability, but is not suitable as a resin composition for a neutron shielding material in terms of hydrogen content. This composition system considerably differs from that in Example 2 in that an amine curing agent is used instead of a cationic polymerization initiator. As is also clear from comparison of the composition of Comparative Example 2 with the composition of Comparative Example 3, heat resistance and heat stability are improved by curing with a polymerization initiator.

Comparative Example 3

A bisphenol A epoxy resin (Epicoat 828, structural formula (15)) as an epoxy resin was mixed with a polyamine curing agent at a mixing ratio of 1:1 (stoichiometrically equal), and the mixture was stirred to prepare a resin composition used for a neutron shielding material. A density increasing agent was not added.

As a result of measuring the hydrogen content in the resin composition, the hydrogen content was 9.8 wt % or more which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was about 99 wt % or less, and the temperature at a residual weight ratio of 90 wt % was 300° C. or less, meaning that the composition exhibited heat resistance and heat stability inferior to those of the compositions of Examples.

This composition system imitates the same system as in a conventionally used resin composition for a neutron shielding material. The composition of Comparative Example 4 is suitable in terms of hydrogen content, but has low heat resistance and heat stability as compared with those of the compositions of Examples. It can be found that the compositions of Examples have excellent heat resistance and heat stability.

Comparative Example 4

81.7 g of an epoxy resin having a structure in which OH at each end of polypropylene glycol is substituted with glycidyl ether (epoxy equivalent: 190) and 18.3 g of isophoronediamine as a curing agent were sufficiently stirred to prepare a resin composition used for a neutron shielding material. A density increasing agent was not added.

As a result of measuring the hydrogen content in the resin composition, the hydrogen content was 9.8 wt % or more which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was 99.5 wt % or less, and the temperature at a residual weight ratio of 90 wt % was 250° C. or less, meaning that the composition exhibited heat resistance and heat stability extremely inferior to those of the compositions of Examples.

Comparative Example 5

78.5 g of 1,6-hexane diglycidyl ether (epoxy equivalent: 155) as an epoxy resin and 21.5 g of isophoronediamine as a curing agent were sufficiently stirred to prepare a resin composition used for a neutron shielding material. A density increasing agent was not added.

As a result of measuring the hydrogen content in the resin composition, the hydrogen content was 9.8 wt % or more which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was 99.5 wt % or less, and the temperature at a residual weight ratio of 90 wt % was 300° C. or less, meaning that the composition exhibited heat resistance and heat stability inferior to those of the compositions of Examples.

Comparative Example 6

Here, a neutron absorbent was added to a conventional resin component to evaluate the neutron shielding effect. 50 g of a bisphenol A epoxy resin (Epicoat 828, structural formula (15)) as an epoxy resin was mixed with 50 g of a polyamine curing agent, and the mixture was stirred. 146.5 g of magnesium hydroxide and 3.5 g of boron carbide were mixed therewith, and the mixture was stirred to prepare a resin composition for a neutron shielding material. A density increasing agent was not added.

The reference hydrogen content required for a neutron shielding material is a hydrogen content density of 0.096 $g/cm^3$ or more. The hydrogen content density of the prepared neutron shielding material composition was measured to be 0.096 $g/cm^3$ or more, which satisfied the standard. On the other hand, the resin composition for a neutron shielding material was cured at 80° C. for 30 minutes and at 150° C. for 2 hours to measure the weight reduction by heat in the same manner as in Example 1. As a result, the residual weight ratio at 200° C. was about 99 wt % or less, and the temperature at a residual weight ratio of 90 wt % was 300° C. or less, meaning that the composition exhibited heat resistance and heat stability inferior to those of the compositions of Examples.

The cured product was enclosed in a closed vessel, and a thermal endurance test was carried out at 190° C. for 1,000 hours. The compressive strength was decreased by 30% or more as compared with that before the test, meaning that the composition has low durability in a high-temperature environment.

This composition system imitates the same system as in a conventionally used neutron shielding material composition. The composition of Comparative Example 6 is suitable in terms of hydrogen content, but has low heat resistance and heat stability as compared with those of the compositions of Examples 11 and 12. It can be found that the compositions of Examples have excellent heat resistance and heat stability.

As is clear from the above Examples and Comparative Examples, resins cured with the polymerization initiator of the present invention have a temperature at a residual weight ratio of 90 wt % increased by 30 to 50° C. on average as compared with resins using the same polymerization component cured with an amine curing agent, and such resins has high heat resistance.

A neutron shielding material is obtained from the neutron shielding material composition of the present invention by curing a heat-resistant polymerization component with a cationic polymerization initiator. When a shielding material is prepared by curing the composition of the present invention polymerizable without using a curing agent component that has a bond easily decomposed under high-temperature conditions, the shielding material has an increased heat-resistant temperature and has ensured neutron shielding effect. Accordingly, the present invention can provide a composition for a neutron shielding material that can endure long-term storage of spent nuclear fuels. Further, since the composition of the present invention comprises a density increasing agent, the neutron shielding material can provide an increased neutron absorption while maintaining secondary γ-ray shielding performance.

The invention claimed is:

1. A neutron shielding material composition comprising:

a polymerization initiator;

a polymerization component;

a refractory material having higher density than that of a resin component comprising said polymerization initiator and said polymerization component;

a density increasing agent having higher density than that of said refractory material;

a boron compound, wherein said neutron shielding material composition maintains the density of a base resin comprising said resin component and said refractory material; and wherein density of the neutron shielding material composition is from 1.62 g/cm$^3$ to 1.72 g/cm$^3$.

2. The neutron shielding material composition according to claim 1, wherein the composition does not comprise a curing agent.

3. The neutron shielding material composition according to claim 1, wherein the polymerization component comprises an epoxy component.

4. The neutron shielding material composition according to claim 3, wherein the epoxy component comprises a hydrogenated epoxy compound.

5. The neutron shielding material composition according to claim 3, wherein the epoxy component comprises a compound of the structural formula (1):

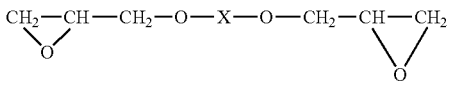

(1)

wherein X is at least one compound selected from the group consisting of compounds of the structural formulas (2), (3), (4), (5) and (6):

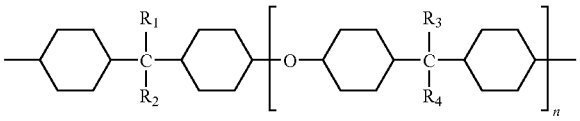

(2)

-continued

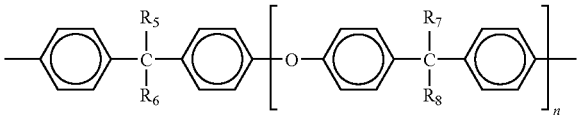

(3)

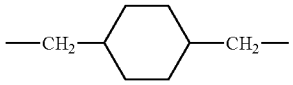

(4)

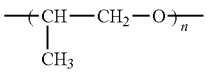

(5)

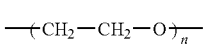

(6)

wherein $R_1$ to $R_4$ are each independently selected from the group consisting of $CH_3$, H, F, Cl and Br, and n is 0 to 2 in the structural formula (2), $R_5$ to $R_8$ are each independently selected from the group consisting of $CH_3$, H, F, Cl and Br, and n is 0 to 2 in the structural formula (3), n is 1 to 12 in the structural formula (5), and n is 1 to 24 in the structural formula (6).

6. The neutron shielding material composition according to claim 3, wherein the epoxy component comprises a compound of the structural formula (14):

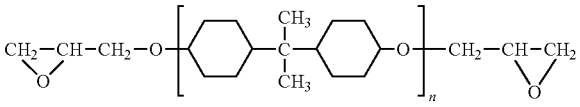

(14)

wherein n is 1 to 3.

7. The neutron shielding material composition according to claim 3, wherein the epoxy component comprises at least one compound selected from the group consisting of compounds of the structural formulas (7), (8), (15), and (17):

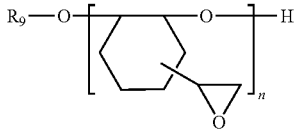

(7)

wherein $R_9$ is a C1-10 alkyl group or H, and n is 1 to 24; a compound of the structural formula (8):

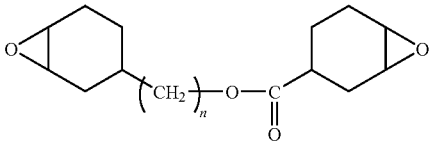

(8)

wherein n is 1 to 8; a compound of the structural formula (15):

(15)

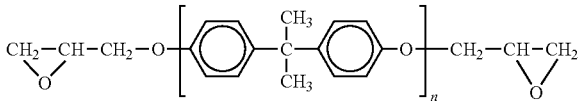

wherein n is 1 to 3; and a compound of the structural formula (17)

(17)

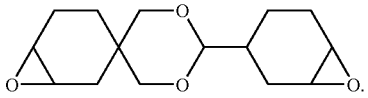

8. The neutron shielding material composition according to claim 1, further comprising a compound for increasing the hydrogen content in the composition.

9. The neutron shielding material composition according to claim 1, wherein the compound for increasing the hydrogen content in the composition comprises at least one of compounds of the structural formulas (9) and (10):

(9)

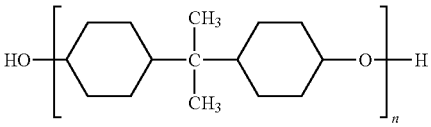

(10)

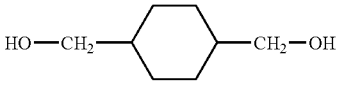

wherein n is 1 to 3.

10. The neutron shielding material composition according to claim 1, comprising an oxetane compound as the polymerization component.

11. The neutron shielding material composition according to claim 10, wherein the oxetane compound comprises at least one of compounds of the structural formulas (19) and (20)

(19)

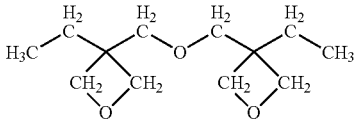

-continued (20)

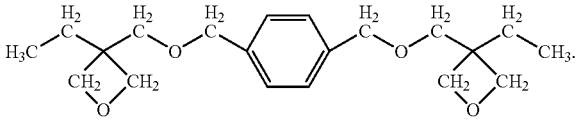

12. The neutron shielding material composition according to claim 1, wherein the polymerization initiator comprises a cationic polymerization initiator.

13. The neutron shielding material composition according to claim 12, wherein the cationic polymerization initiator comprises a compound of the structural formula (11) or (16):

(11)

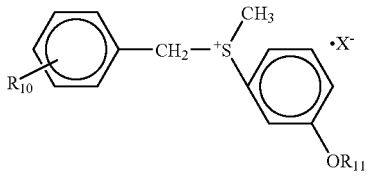

(16)

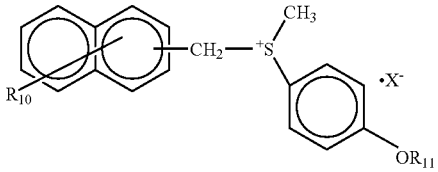

wherein $R_{10}$ is a hydrogen atom, a halogen atom, a nitro group or a methyl group, $R_{11}$ is a hydrogen atom, $CH_3CO$ or $CH_3OCO$, and x is $SbF_6$, $PF_6$, $BF_4$ or $AsF_6$.

14. The neutron shielding material composition according to claim 1, further comprising a filler.

15. The neutron shielding material composition according to claim 1, wherein the refractory material comprises at least one of magnesium hydroxide and aluminum hydroxide.

16. The neutron shielding material composition according to claim 1, wherein the density increasing agent is a metal powder having a density of 5.0 to 22.5 g/cm$^3$, a metal oxide powder having a density of 5.0 to 22.5 g/cm$^3$, or a combination thereof.

17. A neutron shielding material produced from the neutron shielding material composition according to claim 1.

18. A neutron shielding container produced from the neutron shielding material according to claim 17.

19. The neutron shielding material composition according to claim 15, wherein said magnesium hydroxide is obtained from sea water magnesium.

* * * * *